US006280166B1

(12) United States Patent
Shiraishi

(10) Patent No.: US 6,280,166 B1
(45) Date of Patent: Aug. 28, 2001

(54) COMPRESSOR HAVING A VALVE MECHANISM OF RELATIVELY HIGH ACCURACY

(75) Inventor: Atsushi Shiraishi, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/513,137

(22) Filed: Feb. 25, 2000

(30) Foreign Application Priority Data

Mar. 5, 1999 (JP) ..... 11-058163

(51) Int. Cl.[7] ..... F01C 1/02

(52) U.S. Cl. ..... 418/55.1; 418/270; 137/533.11; 137/533.15

(58) Field of Search ..... 418/55.1, 270; 137/533.15, 533.11

(56) References Cited

U.S. PATENT DOCUMENTS

| | | | | |
|---|---|---|---|---|
| 3,727,635 | * | 4/1973 | Todd | 137/533.15 |
| 3,741,243 | * | 6/1973 | Deibler et al. | 137/528 |
| 3,787,149 | * | 1/1974 | Dane et al. | 137/533.11 |
| 4,243,067 | * | 1/1981 | Rubey | 137/533.15 |
| 4,601,305 | * | 7/1986 | Nordskog | 137/533.11 |
| 4,633,681 | * | 1/1987 | Webber | 137/533.11 |
| 6,098,958 | * | 8/2000 | Becker | 137/533.11 |

FOREIGN PATENT DOCUMENTS

| | | | | |
|---|---|---|---|---|
| 966387 | * | 4/1975 | (CA) | 137/533.11 |
| 5-231351 | | 9/1973 | (JP) . | |
| 55-139566 | * | 10/1980 | (JP) | 137/533.11 |
| 57-057967 | * | 4/1982 | (JP) | 137/533.11 |
| 9-273489 | * | 10/1997 | (JP) | 137/454.4 |

* cited by examiner

*Primary Examiner*—Thomas Denion
*Assistant Examiner*—Theresa Trieu
(74) *Attorney, Agent, or Firm*—Baker Botts L.L.P.

(57) ABSTRACT

In a compressor in which a gas passage is made to have a first and a second end portion opposite to each other and conducts a gaseous fluid from the first end portion to the second end portion, a valve seat member is press-fitted into the first end portion of the gas passage to define a valve chamber in the gas passage. A valve body is movably placed in the valve chamber for checking a back flow of the gaseous fluid only when the valve body is seated on the valve seat member. At the second end of the gas passage, a valve stopper is formed for preventing a displacement of the valve body without closing the gas passage.

8 Claims, 4 Drawing Sheets

COMPRESSOR HAVING A VALVE MECHANISM OF RELATIVELY HIGH ACCURACY

BACKGROUND OF THE INVENTION

The present invention relates to a compressor for compressing a gaseous fluid and, more particularly, to a compressor having a valve mechanism in a gas passage for preventing a back flow of the gaseous fluid.

A conventional compressor is disclosed in Japanese Unexamined Patent Publication (JP-A) No. 5-231351. The conventional compressor is generally called a scroll type compressor and is used for circulating a gaseous fluid in an endless circuit. The conventional compressor includes a compressing chamber for compressing the gaseous fluid, a discharge chamber for receiving the gaseous fluid discharged from the compressing chamber, and a gas passage connected between the compressing chamber and the discharge chamber. For preventing a back flow of the gaseous fluid, the compressor is provided in the gas passage with a valve mechanism or a check valve which will later be described in detail in conjunction with the drawing.

The valve mechanism comprises a valve seat and a valve body opposite to the valve seat. When seated on the valve seat, the valve body closes the gas passage. When removed or apart from the valve seat, the valve body opens the gas passage. In the valve mechanism used in the conventional compressor, the valve seat is formed integral with the gas passage. In other words, the gas passage is made or worked to have the valve seat as a part thereof.

In order to prevent the back flow of the gaseous liquid by the valve mechanism, it is necessary to make the valve seat have high accuracy. However, it is difficult or hard to make the valve seat in high accuracy because the valve seat is formed integral with the gas passage.

SUMMARY OF THE INVENTION

It is therefore an object of the present invention to provide a compressor having a valve mechanism of relatively high accuracy.

Other objects of the present invention will become clear as the description proceeds.

According to the present invention, there is provided a compressor which comprises a gas passage having a first and a second end portion opposite to each other and being for conducting a gaseous fluid from the first end portion to the second end portion, a valve seat member press-fitted into the first end portion to define a valve chamber in the gas passage, a valve body movably placed in the valve chamber for checking a back flow of the gaseous fluid only when the valve body is seated on the valve seat member, and a valve stopper formed at the second end for preventing a displacement of the valve body without closing the gas passage.

DESCRIPTION OF THE PREFERRED EMBODIMENTS

Figure 1:
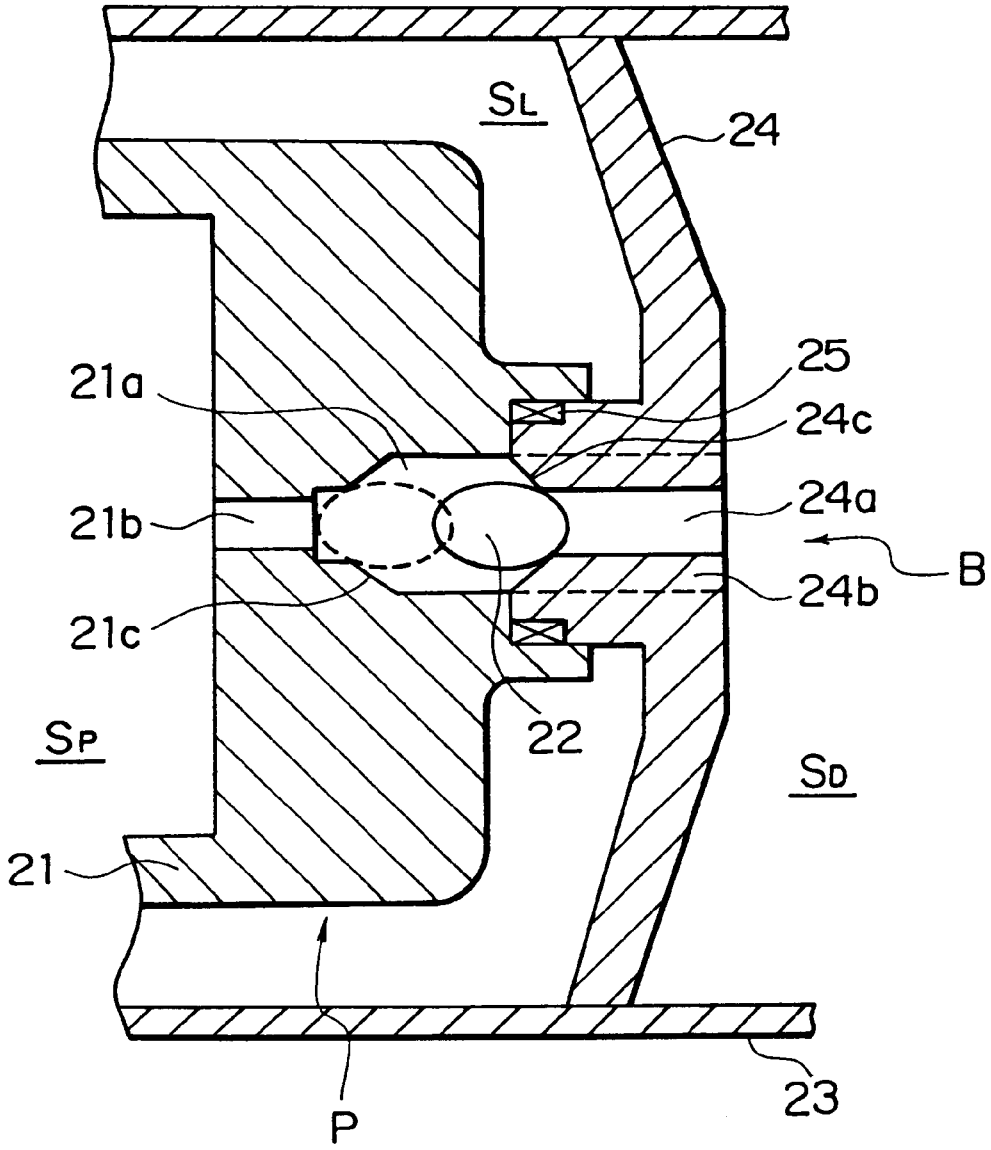
FIG. 1 PRIOR ART
FIG. 1 is a sectional view of a part of a conventional compressor.

For better understanding of the present invention, description will be made at first as regards a conventional compressor with reference to FIG. 1. The illustrated compressor corresponds to that disclosed in Japanese Unexamined Patent Publication (JP-A) No. 5-231351 described in the preamble part. The compressor is generally called a scroll type compressor and comprises a discharge valve mechanism B.

In the illustrated compressor, a discharge cover 24 with a seal ring 25 is housed in a sealed housing 23. A compression space or chamber SP, a low pressure space or chamber SL, and a discharge space or chamber SD are confined on the wall surfaces of a fixed scroll 21. The discharge valve mechanism B is provided at a boarder between the discharge cover 24 and the fixed scroll 21.

For communicating the compression chamber SP with the discharge chamber SD, the discharge valve mechanism B has a gas passage comprising a columnar opening portion 24*a* in the discharge cover 24, a passage hole 21 a formed on the fixed scroll 21, and a discharge port 21*b* connected in an offset manner with the passage hole 21*a*. The discharge chamber SD is deemed to be a high pressure chamber since it is higher in pressure than a low pressure chamber SL.

The discharge valve mechanism B includes a valve body 22 which is of an oval structure and movably housed in the passage hole 21*a* having the largest diameter in the gas passage so that the oval valve body 22 is moved according to a difference between a pressure in the compression chamber SP and a pressure in the discharge chamber SD. The discharge valve mechanism B further includes a first stopper portion 24*c* forming a portion of a columnar opening portion 24*a* of the discharge cover 24 and projecting into the passage hole 21*a*, and a second stopper portion 21*c* as a valve seat forming an inclined surface in the passage hole 21*a* of the fixed scroll 21.

In the structure described above, an opening diameter of the columnar opening portion 24*a* and an opening diameter of the passage hole 21*a* connecting with a discharge port 21*b* are formed smaller than a diameter of a minor or shorter axis of the valve body 22. An opening diameter of the columnar opening portion 24*a* and the opening diameter of a portion which is connected with the discharge port 21*b* substantially equal to each other.

In the discharge valve mechanism B, when a pressure in the compression chamber SP is higher than a pressure in the discharge chamber SD, the valve body 22 is moved toward the discharge chamber SD until the first stopper portion 24*c* as shown by a solid line in the illustration. At this moment, a gaseous fluid is flown from a gas groove 24*b* on the circumference of a circular opening portion 24*a* of the discharge cover 24 to the discharge chamber SD.

On the other hand, when a pressure in the discharge chamber SD is higher than a pressure in the compression chamber SP, the valve body 22 is moved toward the compression chamber SP until the second stopper 21*c* as shown by dotted line. At this moment, the passage hole 21*a* is completely closed by the valve body 22 to thereby close the discharge port 21*b*, so that the gaseous fluid is prevented from flowing from the discharge chamber SD to the compression chamber SP.

With the conventional compressor, it is difficult or hard to make the second stopper 21*c* in high accuracy because the second stopper 21*c* is formed integral with the gas passage.

Figure 2:
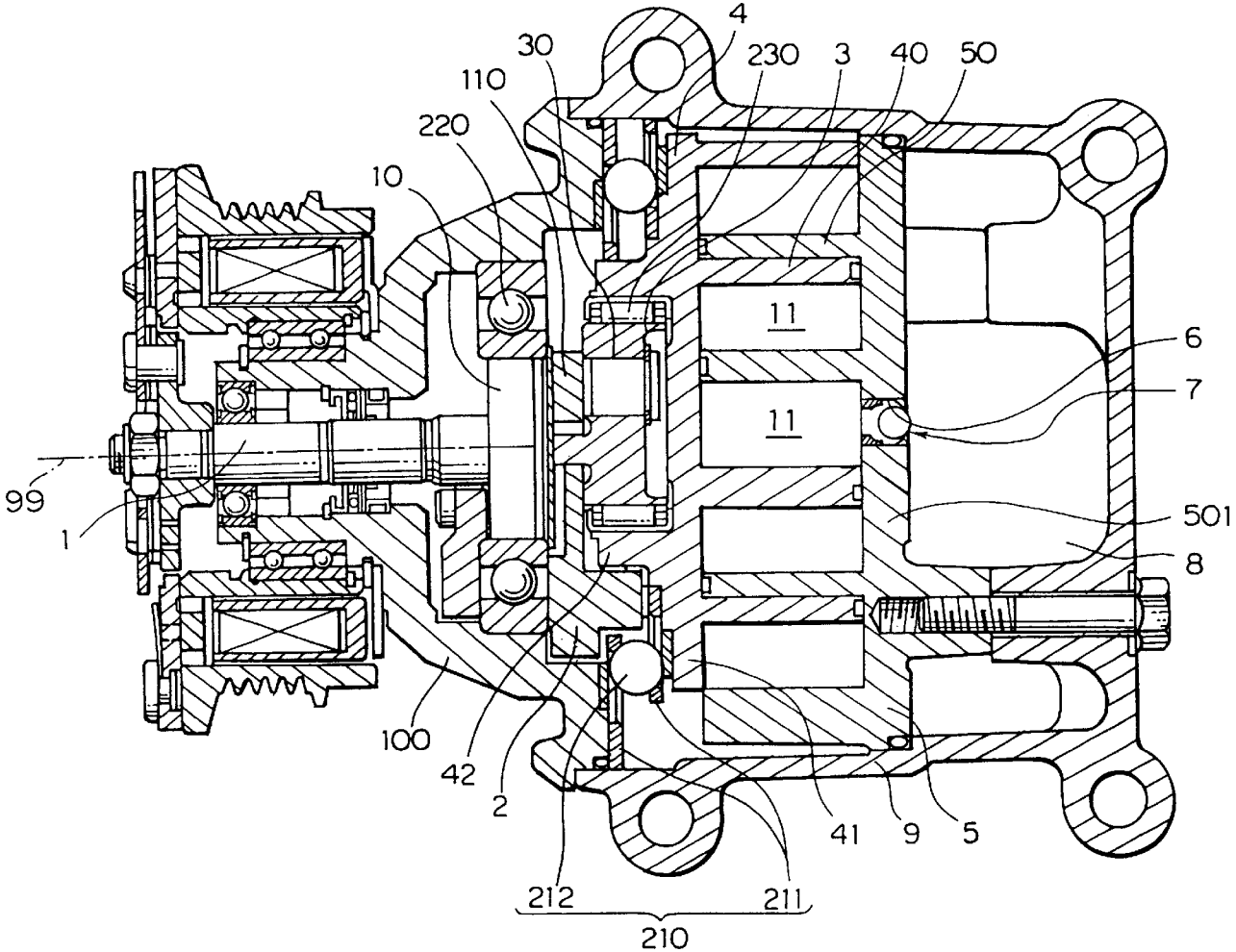
FIG. 2 PRIOR ART
FIG. 2 is a longitudinal sectional view of a compressor according to an embodiment of the present invention.

With reference to FIG. 2, the description will be made as regards a compressor according to an embodiment of the present invention. The compressor is of a scroll type and therefore is generally called a scroll-type compressor.

In the manner which will presently be described, the scroll compressor comprises a drive shaft or a crank shaft 1, a counterweight 2, an eccentric bush 3, a movable scroll 4, and a fixed scroll 5. The crank shaft 1 has an enlarged spindle portion 10 with a crank pin 110 eccentrically coupled thereto. The rotation of the crank shaft 1 on its own axis 99 (depicted by a dash-and-dot line in FIG. 2) causes the revolution of the crank pin 110 around the axis 99 of the crank shaft 1. The crank pin 110 is fitted into a crank pin receptacle 30 formed in the eccentric bush 3. The revolution of the crank pin 110 provides the revolution of the eccentric bush 3.

The movable scroll 4 has a side plate 41, a spiral or involute lap 40 formed on one side of the side plate 41, and an annular boss 42 formed on the other side. The spiral or involute lap 40 will be called hereinafter a spiral element. The eccentric bush 3 is coupled to the boss 42 via a needle bearing 230 to be smoothly rotatable in the boss 42.

With the above-mentioned structure, the eccentric bush 3 and the movable scroll 4 coupled thereto perform the revolution with respect to the crank shaft 1.

In order to suppress the rotation of the movable scroll 4, a rotation inhibiting mechanism 210 is provided. The rotation inhibiting mechanism 210 comprises a pair of annular races 211 and a ball 212. By the rotation inhibiting mechanism 210, the movable scroll 4 is allowed to perform the orbiting motion alone.

Furthermore, the movable scroll 4 and the fixed scroll 5 are arranged to be eccentric with each other by a predetermined distance with the spiral elements 40 and 50 shifted from each other by an angle of 180°. With this structure, a plurality of closed spaces 11 are defined as compression chambers between the spiral elements 40 and 50 as illustrated in FIG. 2. An inner one and an outer one of the closed spaces 11 are smaller and greater in volume, respectively.

Therefore, a gaseous fluid such as a refrigerant gas sucked into the closed spaces through a suction port (not shown) is transferred radially inward to be gradually compressed into a compressed fluid. Finally, the compressed fluid is led to a gas passage or a discharge port 6 made to penetrate a base end wall 501 of the fixed scroll 5. The discharge port 6 has a first end portion adjacent to the inner one of the closed spaces 11 and a second end portion adjacent to the discharge chamber 8. The base end wall 501 will be referred to as a plate member.

Figure 3:
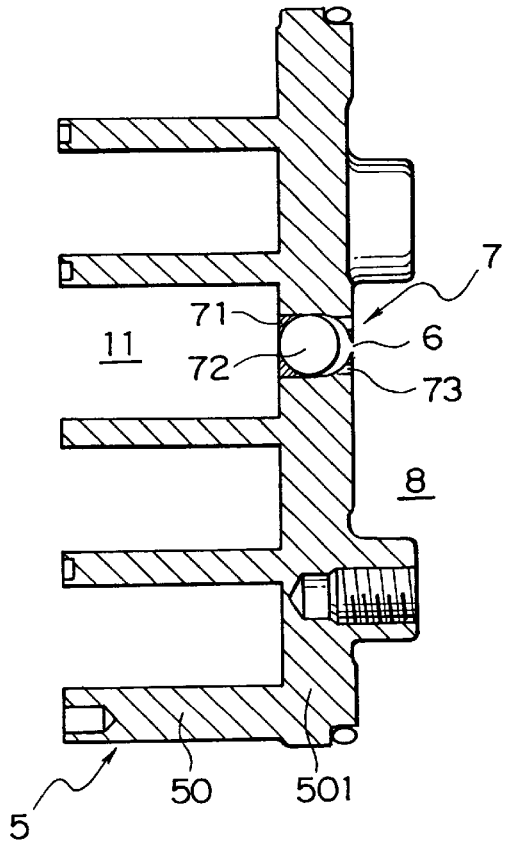
FIG. 3 is a sectional view of a fixed scroll included in the compressor of FIG. 2.
Figure 4:
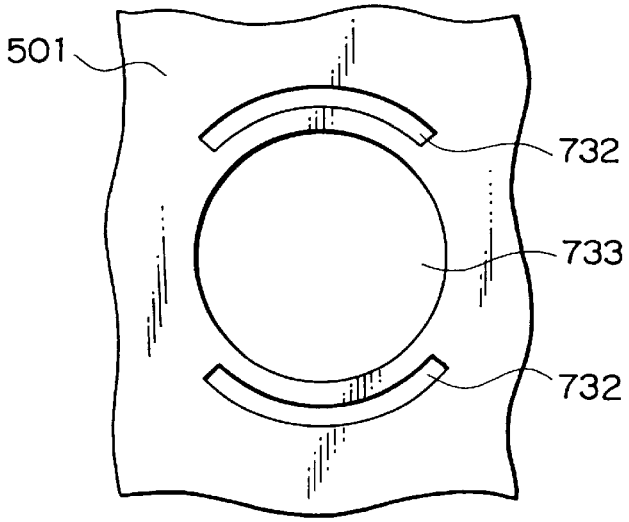
FIG. 4 is an enlarged side view of a part of the fixed scroll of FIG. 3.

Referring to FIGS. 3 and 4 together with FIG. 2, the discharge port 6 is connected to a discharge chamber 8 through a discharge valve mechanism 7 assembled in the base end wall 501. The discharge chamber 8 is kept at a high pressure. In the manner which will later become clear, the discharge valve mechanism 7 is normally closed under the high pressure in the discharge chamber 8. When the compressed fluid reaches the discharge port 6, the discharge valve mechanism 7 is opened under an increased pressure in the discharge port 6 so that the compressed fluid is discharged into the discharge chamber 8.

Thus, a series of operations mentioned above are carried out when the fluid is compressed by the scroll compressor. The components mentioned above are sealed in a casing 9 and a front housing 100 to be protected.

Figure 5A:
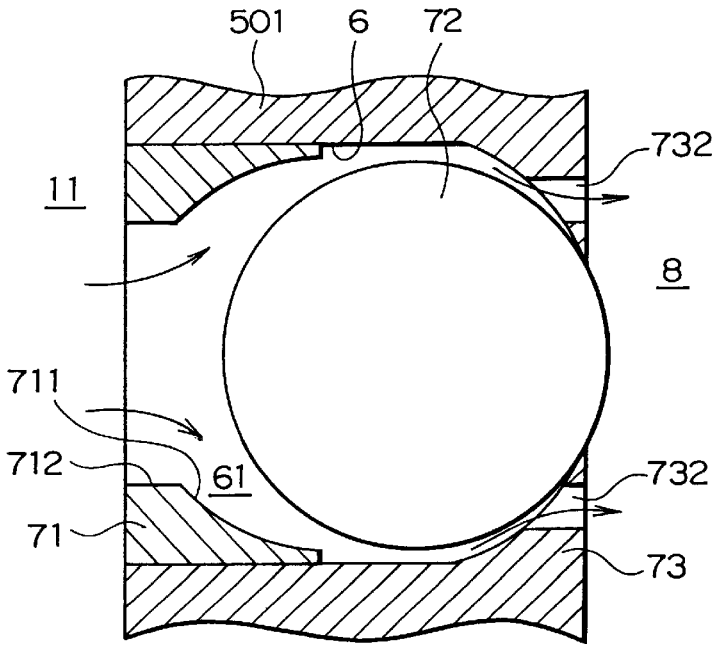
FIGS. 5A and 5B are enlarged sectional views for describing an operation of the valve mechanism included in the compressor of FIG. 2.
Figure 5B:
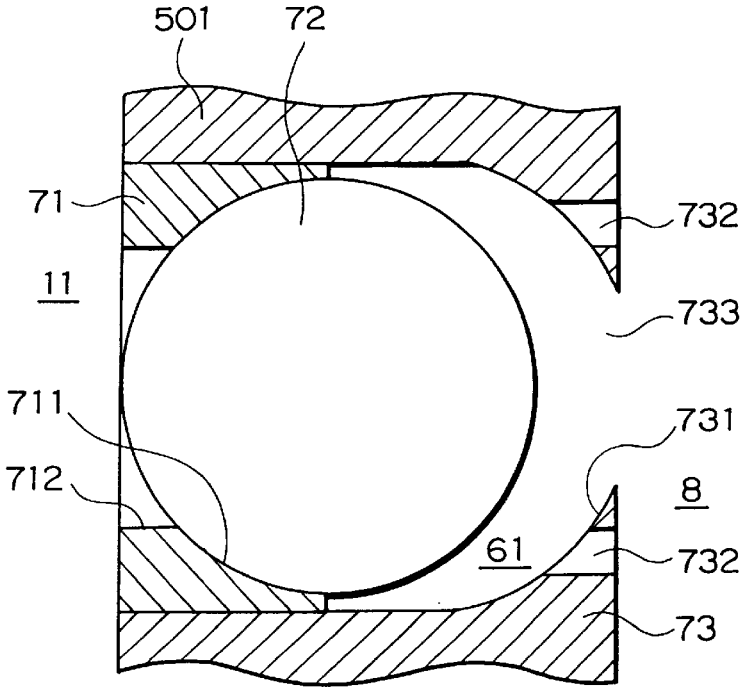

Referring to FIGS. 5A and 5B in addition, the discharge valve mechanism 7 comprises a valve seat member 71 press-fitted into the first end portion of the discharge port 6 and fixed thereto to define a valve chamber 61 in the discharge port 6, a valve body 72 movably placed in the valve chamber 61, and a valve stopper 73 formed integral with the base end wall 501 at the second end. The valve body 72 is of a spherical shape having a predetermined diameter and a predetermined curvature. The predetermined diameter is smaller than the diameter of the valve chamber 61.

The valve seat member 71 has a spherical surface 711 of a ring shape and an opening portion 712 inside the spherical surface 711. The spherical surface 711 is for serving as a valve seat and has a curvature substantially equal to the predetermined curvature. The opening portion 712 has a diameter smaller than the predetermined diameter. When seated on the valve seat member 71 as shown in FIG. 5B, the valve body 72 becomes in close contact with the spherical surface 711 to close the opening portion 712. When separated from the valve seat member 71 as shown in FIG. 5A, the valve body 72 opens the opening portion 712 to permit the gaseous fluid flow through the discharge port 6.

The valve stopper 73 has a spherical surface 731 along a ring shape for engaging with the valve body 72. The spherical surface 731 has a curvature different from the predetermined curvature. More particularly, the first curvature is determined smaller than the predetermined curvature. The valve stopper 73 further has a pair of gas holes or slots 732 made therein outside the spherical surface 731 and an opening portion 733 made therein inside the spherical surface 731. The opening portion 733 having a diameter smaller than said predetermined diameter.

More particularly, the inner wall portion in the second end portion of the gas passage 6 is connected with the opening portion 733 that has an opening diameter smaller than the predetermined diameter and a curved surface of a curvature smaller than the predetermined curvature. Further, at an outer portion relative to a portion to which the valve body 72 is contacted at a circumferential portion of the opening portion 733, the gas holes 732 are connected with the inner wall portion of the discharge chamber 8 side to thereby permit the gaseous fluid to flow out. The valve seat member 71 has the opening portion 712 that has an opening diameter smaller than the predetermined diameter and also has a curved surface which blocks off a flow of the gaseous fluid in such a manner that the inner wall portion connected with the opening portion 712 is contacted with the valve body 72. Further, the opening diameter of the opening portion 712 is made larger than the opening diameter of the opening portion 733. The curved surface of the inner wall portion in the valve seat member 71 has the curvature that is equal to the predetermined curvature.

Referring to FIG. 4 shortly, each of the gas holes or slots 732 is of a belt-like arch configuration. It should be appreciated, however, the shape of the gas holes 732 is not limited to the belt-like arch configuration described above but other desired shapes can be applied provided that it meets the requirement that the gas holes 732 is connected with the inner wall portion of the discharge chamber 8 and permits the gaseous fluid to flow out from the circumferential area of the valve body 72. In addition, it should be appreciated that the number of the gas holes 732 is not limited to that of the embodiment described above.

In FIG. 5A showing a state of the compression operation of the compressor under the condition that a pressure in the discharge chamber 8 is lower than a pressure in the compression chamber 11, the inner one of the closed spaces or compression chamber 11 has a pressure higher than that in the discharge chamber 8. In this state, the valve body 72 is moved toward the discharge chamber 8 by the large pressure of the compression chamber 11 until it contacts the spherical surface 731 of the valve stopper 73. Simultaneously, a part of the valve body 72 is fitted to the opening portion 733 to have a part projected towards the discharge chamber 8. Thus, the gaseous fluid flows from the compression chamber 11 to the discharge chamber 8 through the opening portion 712 of the valve seat member 71, through an outside area of the valve body 72, and through the gas holes 732. In this event, a flowing pressure of the gaseous fluid in the gas holes 732 serves to enhance or urge the valve body 72 to contact with the spherical surface 731 of the stopper portion 73.

In FIG. 5B showing another state of the compression operation of the compressor under the condition that a pressure in the discharge chamber 8 is higher than a pressure in the compression chamber 11, the valve body 72 is moved toward the compression chamber 11 by a large pressure of the discharge chamber 8 until it contacts the spherical surface 711 of the valve seat member 71. Thus, the movement of the valve body 72 is ceased. At this moment, the refrigerant gas is prohibited to pass from the discharge chamber 8 to the compression chamber 11, because the opening portion 712 is closed by the valve body 72 that is contacted against the valve seat member 71.

With this structure, it is easy to form the gas passage and to provide the spherical surface 711. In addition, it can be closed in a stable manner by the valve body 72 with a relatively small number of parts and elements and consequently improvements in durability and operability can be attained. As a result, there is no problem of positional accuracy in assembly of the discharge valve as experienced. Furthermore, there is no problem of valve breakage or crack due to discharging pulsation or irregular collision of a valve. Thus, a stable operation is assured with desired durability and a reliable operation can be obtained as a desired discharge valve mechanism.

While the present invention has thus far been described in connection with a single embodiment thereof, it will readily be possible for those skilled in the art to put this invention into practice in various other manners. For example, the inner wall portion of the stopper portion may has a curvature smaller than that of the valve body. Although the description is made as regards the scroll-type compressor, this invention is applicable to piston-type compressors well known in the art.

What is claimed is:

1. A compressor comprising:

a gas passage having a first and a second end portion opposite to each other and being for conducting a gaseous fluid from said first end portion to said second end portion;

a valve seat member press-fitted into said first end portion to define a valve chamber in said gas fluid;

a valve body movably placed in said valve chamber for checking a back flow of said gaseous fluid only when said valve body is seated on said valve seat member; and a valve stopper formed at said second end for preventing a displacement of said valve body without closing said gas passage, wherein said valve body has a surface with a predetermined curvature, and said valve stopper has a surface with a stopper curvature different from said predetermined curvature.

2. The compressor of claim 1, wherein said valve body is of a spherical shape having a predetermined diameter.

3. The compressor of claim 2, wherein said valve stopper has a spherical surface along a ring shape for engaging with said valve body.

4. The compressor of claim 3, wherein said stopper curvature is smaller than said predetermined curvature.

5. The compressor of claim 3, wherein said valve stopper further has a plurality of gas holes made outside said spherical surface.

6. The compressor of claim 3, wherein said valve stopper further has an opening portion made inside said spherical surface, said opening portion having a diameter smaller than said predetermined diameter.

7. The compressor of claim 2, wherein said valve seat member has a spherical surface of a ring shape and an opening portion inside said spherical surface, said opening portion having a diameter smaller than said predetermined diameter, said valve body becoming in close contact with said spherical surface to close said opening portion when said valve body is seated on said valve seat member.

8. The compressor of claim 1, further comprising:

a plate member defining said gas passage;

a compression chamber placed at one side of said plate member and connected to said first end portion of the gas passage for supplying said gaseous fluid to said gas passage; and a discharge chamber placed at an opposite side of said plate member and connected to said second end portion of the gas passage for receiving said gaseous fluid from said gas passage.

* * * * *